US006375085B1

(12) United States Patent
Martin et al.

(10) Patent No.: US 6,375,085 B1
(45) Date of Patent: Apr. 23, 2002

(54) REDUCING NOISE IN A THERMAL EXPANSION VALVE

(75) Inventors: David L. Martin, Bloomfield Hills; Robert A. Dayton, Attica, both of MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/568,715

(22) Filed: May 11, 2000

(51) Int. Cl.[7] ..... G05D 27/00

(52) U.S. Cl. ..... 236/92 B; 62/225

(58) Field of Search ..... 62/225; 236/92 B

(56) References Cited

U.S. PATENT DOCUMENTS 5,979,780 A * 11/1999 Malone et al. ..... 236/92 B

* cited by examiner

*Primary Examiner*—William Doerrler
*Assistant Examiner*—Mohammad M Ali
(74) *Attorney, Agent, or Firm*—Christopher H. Hunter

(57) ABSTRACT

A thermal expansion valve for controlling flow of refrigerant from a high pressure (condenser) inlet to a low pressure (evaporator) outlet. The main valve is operated by pressure in a temperature sensing fluid filled capsule acting on a diaphragm connected to a valve operating rod. Upstream of the main valve, mounted on the same block is a solenoid operated shutoff valve. A first noise reducing restricting orifice is disposed in the high pressure inlet upstream of the shutoff valve. A second noise reducing restricting orifice is disposed in the shutoff valve which is preferably pilot operated.

19 Claims, 3 Drawing Sheets

REDUCING NOISE IN A THERMAL EXPANSION VALVE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to expansion valves for controlling flow in a refrigerant system between the exothermic heat exchanger or condenser and the endothermic heat exchanger or evaporator and particularly relates to such systems as employed in air conditioning systems for the passenger compartment of motor vehicles.

Known techniques for operating a refrigerant expansion valve include utilizing a liquid filled capsule having a diaphragm responsive to changes of pressure in the capsule due to changes in the temperature of the liquid in the capsule which is in thermally conductive relationship with the refrigerant flowing through the valve and operable to move a valve member for controlling the flow from the high pressure inlet side, connected to the condenser, to the low pressure outlet connected to the evaporator. Such valves although currently popular in high volume production motor vehicle air conditioning systems have the disadvantage that the valve is only reactive to temperature changes in the system and cannot be controlled by an electrical signal provided from a computerized electronic controller. However, it is also known to add an electrically operated solenoid type valve upstream of the diaphragm operated valve in order to provide complete shutoff of the refrigerant flow through the expansion valve to prevent logging or flow in a dual evaporator system.

However, such combination solenoid operated shutoff valve and thermostatic expansion valve have been found to exhibit flow noise through the valve which has been unacceptable to the occupants of the vehicle. Accordingly, it has been desired to provide a way or means of reducing flow induced noise in a refrigerant expansion valve, and particularly one of the type having a solenoid operated shutoff valve combined therewith as employed in motor vehicle air conditioning systems.

BRIEF SUMMARY OF THE INVENTION

The present invention provides a thermally responsive expansion valve for controlling flow in a refrigerant system and is of the type including a solenoid operated shutoff valve incorporated in a common valve block with the flow control valve. The valve block has an inlet adapted for connection to high pressure refrigerant from a condenser and an outlet for providing flow at a reduced pressure adapted for connection to an evaporator. A first restricting orifice is provided in the inlet upstream of the solenoid operated shutoff valve; and, a second restricting orifice of about the same size is provided in the solenoid operated shutoff valve, the results of which are reduced flow noise in the valve when the solenoid operated valve is open and the thermally responsive flow control valve is functioning for varying the flow therethrough. The valve assembly of the present invention is of the well known configuration having a return flow passage through the valve body into which a temperature responsive portion of the flow control valve operator connected to the diaphragm is immersed for temperature sensing.

The noise reducing orifices of the present invention may be conveniently provided between the inlet port and a cross passage for the first orifice and through the valve seat in the shutoff valve for the second orifice.

DETAILED DESCRIPTION OF THE INVENTION

Figure 1:
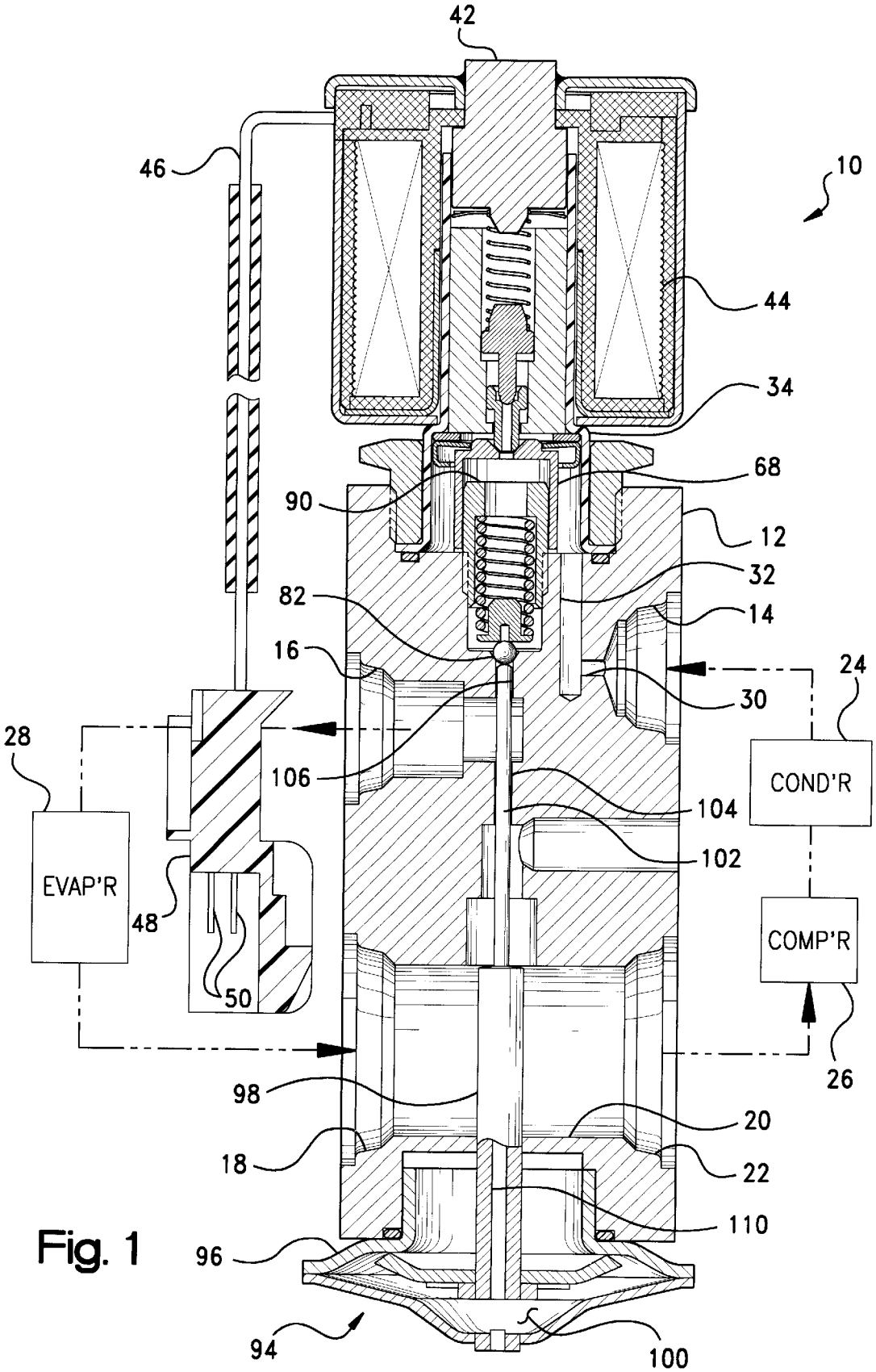
FIG. 1 is a cross-section of the valve assembly of the present invention shown as connected for controlling flow in a refrigerant system.
Figure 2:
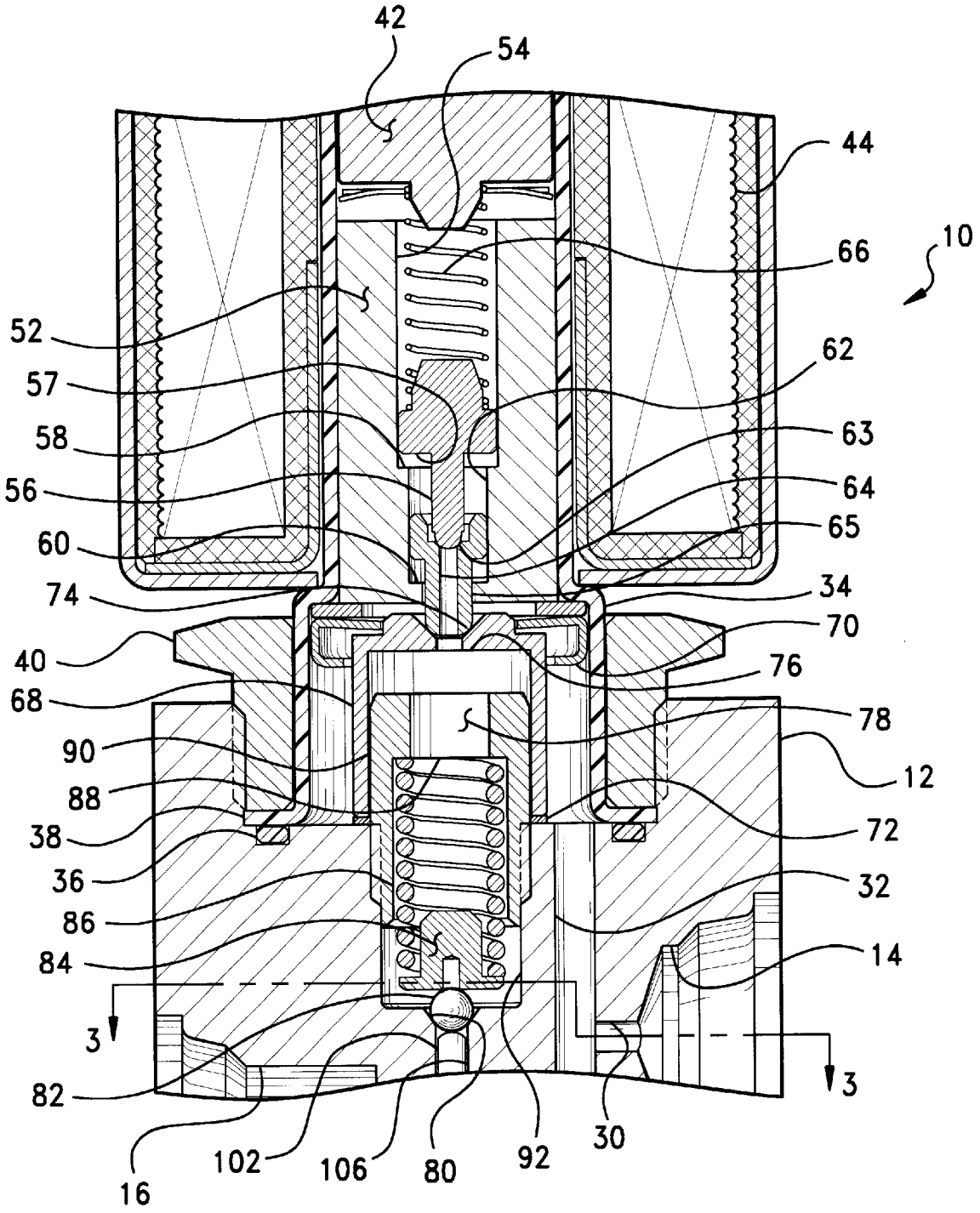
FIG. 2 is an enlarged view of a portion of FIG. 1.
Figure 3:
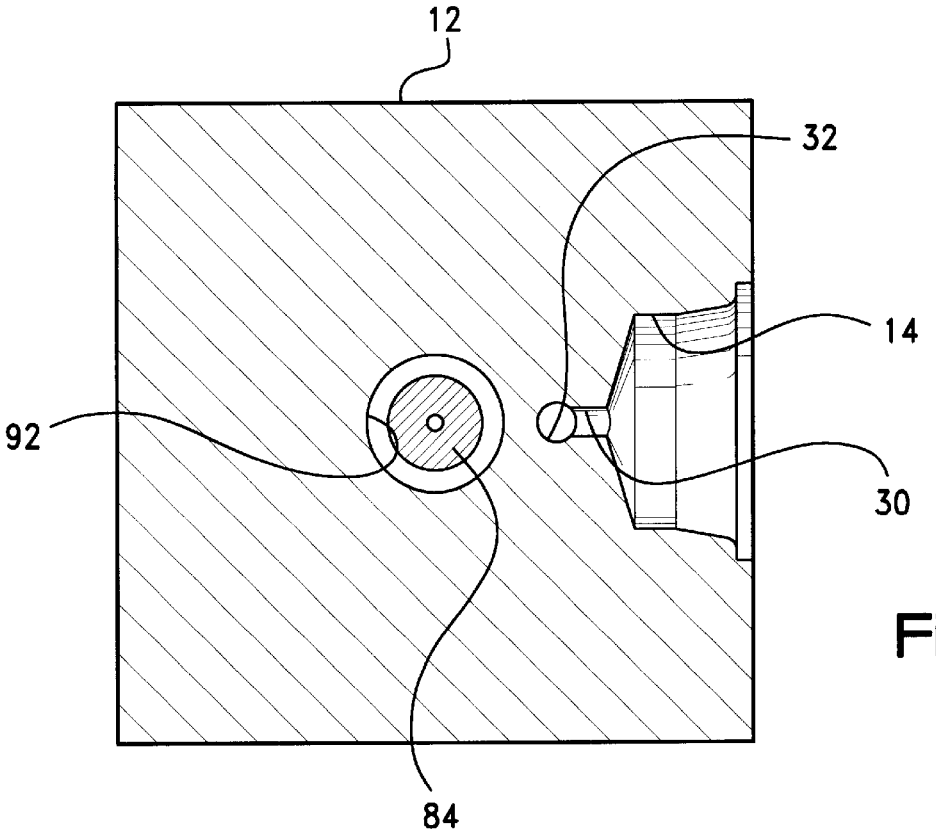
FIG. 3 is a section view taken along section indicating lines 3—3 of FIG. 2; and, FIG. 4 is a view similar to FIG. 3 of an alternate embodiment of the invention.

Referring to FIGS. 1 through 3, the valve assembly of the present invention is indicated generally at 10 and includes a valve body 12 defining a high pressure inlet port 14, a reduced pressure outlet port 16 with a recirculation inlet port 18 communicating openly with a temperature sensing passage 20 and an outlet 22.

In a refrigeration system, the valve 10 has an inlet port 14 adapted for connection to a condenser 24 which is supplied by compressor 26; and, the outlet 16 is adapted for connection through an evaporator 28 which returns flow through inlet 18 and passage 20, outlet 22 to the compressor 26.

High pressure inlet 14 is connected through a first noise reducing orifice 30 to a riser or cross passage 32 which communicates with the interior of an armature guide 34 which has a flange 38 formed at its lower end which is sealed in the end of body 12 by seal ring 36 and retained therein by collar 40 threaded into the block 12. The upper end of the tubular armature guide 34 is sealed by a pole piece or flux collector 42 formed of magnetically permeable material. It will be understood that the armature guide 34 is formed of non-magnetic material.

Armature guide 34 is surrounded by a coil 44 which has electrical leads emanating therefrom in a wiring harness 46 connected to a harness connector 48 having terminal pins 50 provided therein. A magnetically permeable armature 52 is slidably disposed in the armature guide 34. Armature 52 has a bore 54 formed therein which now receives a pilot valve member 56. Armature 52 has a shoulder 58 formed therein which transitions from bore 54 to a reduced diameter portion 62. Pilot valve member 56 has a lower surface 57 facing shoulder 58 of armature 52. A second shoulder 60 is formed in reduced diameter portion 54. A main valve member 65 is slidably received in bore 62. The main valve member 65 has a pilot passage 64 formed therethrough with a valve seat 63 on the upper end thereof which has pilot valve member 56 registered thereagainst and biased thereon by a spring 66 provided in the bore 54.

A main valve seat member 68 is disposed in the lower end of the armature guide and retained therein and biased downwardly by a spring member 70 and sealed against the upper end of the block 12 by a second seal member 72. Valve seat member 68 has an annular tapered valve seat 74 formed thereon against which is closed the main valve member 65. A flow orifice 76 is formed through valve seat 74; and, orifice 76 communicates with the interior of member 68 and a valving chamber 78 which communicates with a valve seat 80 which has a valving member in the form of sphere 82 moveable with respect thereto for controlling flow. Valve member 82 is biased against seat 80 by a plunger 84 which is biased against the valve member 82 by spring 86 disposed in a chamber 78. Spring 86 has its upper end reaction registered against a shoulder 88 provided in a collar 90 threadedly engaging the block 12 in a bore 92 surrounding valve seat 80 and open to passage 76.

A fluid pressure capsule indicated generally at 94 is attached to the lower end of valve body 12 and has a pressure responsive diaphragm 96 provided therein which is attached to an operating rod 98. Capsule 94 has a fluid filled chamber 100 and the changing pressure of the fluid fill acts on the diaphragm 96 and causes rod 98 to move. The rod has a small diameter portion 102 which extends through a passage 104 formed in the valve body for guiding movement of the rod. The end of rod 102 extends further through passage 106 and is positioned to act against the spherical valve member 82 to control the flow through passage 106 which communicates with the discharge port 16. Rod 98 has a hollow interior as denoted by reference numeral 110; and, by virtue of portion 98 passing through passage 20, the fluid within hollow portion 110 is subjected to the temperature of the fluid flowing through passage 20 thereby affecting the temperature of the fluid fill in chamber 100 resulting in pressure changes which cause diaphragm 96 to move the rod 98.

In operation, when coil 44 is energized, armature 52 is moved upward, by the magnetic forces generated from current flow in coil 44, until shoulder 58 registers against the undersurface 57 on pilot valve member 56 and lifts pilot valve member 56 from pilot seat 63 in pilot passage 64 of main valve member 65. The flow through passage 64 creates a pressure drop in bore 54 creating a pressure differential across the upper end of valve member 65. Surface 60 of armature 52 acts on the undersurface of main valve member 65 lifting it from main valve seat 74, and permits flow through passage 76 to valving chamber 78. Once valve 65 has been opened, flow through passage 106 to outlet 16 is controlled by flow control valve member 82, which is actuated by rod 102.

Figure 4:
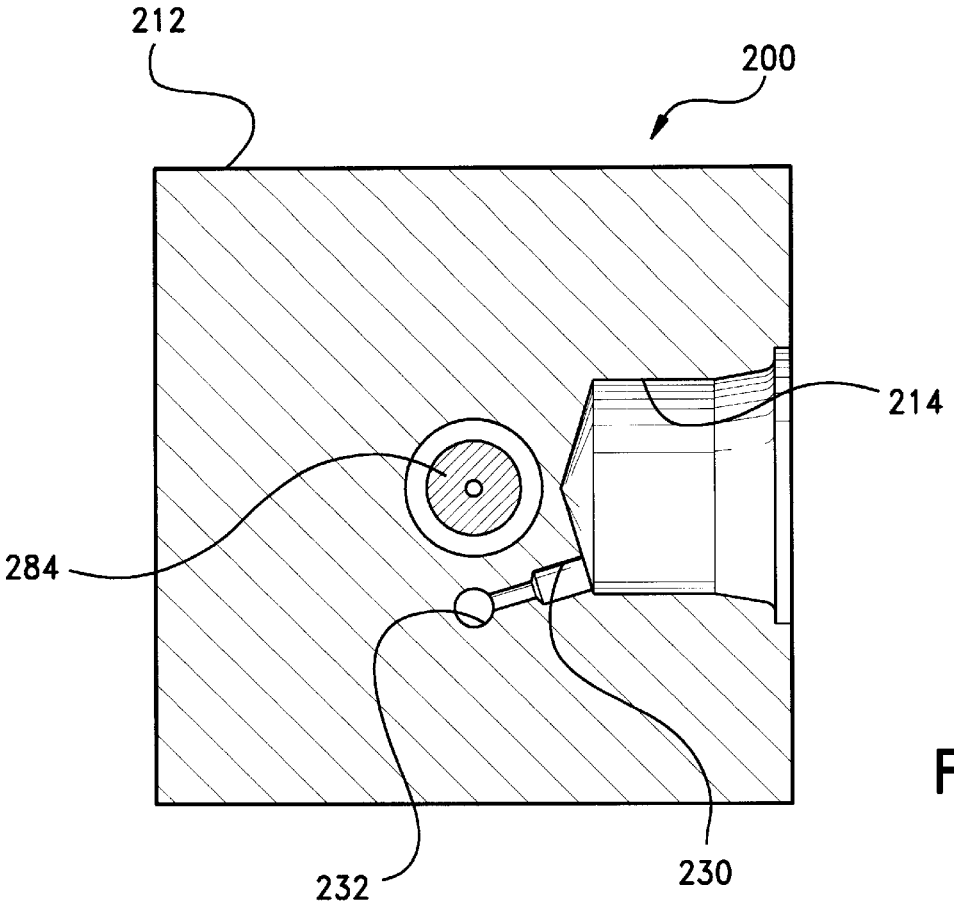

Referring to FIG. 4, an alternate embodiment of the valve is indicated generally at 200 which includes a valve body 212 having a high pressure inlet port 214 which communicates with a noise reducing restricting passage 230 which communicates with a riser passage 232. The riser passage communicates with a valving chamber in a manner similar to the embodiment of FIGS. 1 and 2. It will be understood that with respect to the FIG. 4 embodiment, valve plunger 284 is similar to the plunger 84 of the FIG. 3 embodiment. The embodiment of FIG. 4 thus has the riser passage rotated 90 degrees with respect to the valve body inlet passage 214 to permit the use of a standard length passage 214. In the present practice of the invention, it has been found satisfactory to form the passages 30, 64, 230 at a diameter of about 0.070 inches (1.8 mm); and, the length of the passage 230 has been found satisfactory to have a length of about 0.13 inches (3.3 mm).

The present invention thus provides a thermally responsive expansion valve for controlling flow refrigerant in a refrigeration system, such as an automotive air conditioning system, and employs a solenoid operated cutoff valve at the inlet thereof. The inlet has formed therein a first noise dampening restriction 30; and, the shutoff valve has a second noise dampening restriction 64 formed therein which first and second restrictions together act to reduce flow noise through the valve to an acceptable level.

Although the invention has hereinabove been described with respect to the illustrated embodiments, it will be understood that the invention is capable of modification and variation and is limited only by the following claims.

What is claimed is:

1. A method of suppressing noise in a refrigerant expansion device of the type having a high pressure inlet, a cross passages and a flow path therethrough to a reduced pressure outlet, comprising:

(e) disposing an electrically operated shut-off valve in the flow path downstream from the high pressure inlet and the cross passage;

(f) disposing a thermally responsive flow control valve having a valve seat and valve member moveable with respect to the valve seat in the flow path intermediate said shut off valve and said reduced pressure outlet;

(g) forming a first restricting orifice in the flow path upstream of said shut-off valve seat and intermediate said high pressure inlet and said cross passage for throttling flow between said high pressure inlet and cross passage;

(h) forming a second restricting orifice around the same size as said first orifice in the flow path adjacent said shut-off valve seat on the upstream side thereof and downstream of said first orifice.

2. The method defined in claim 1, wherein said step of forming first and second restricting orifices includes forming orifices which have a diameter of about 0.070 inches (1.78 mm).

3. The method defined in claim 1, wherein said step of disposing a shut-off valve includes electromagnetically operating said valve.

4. The method defined in claim 1, wherein said step of disposing a shut-off valve includes pilot operating said valve.

5. The method defined in claim 1, wherein said step of disposing a flow control valve includes moving said valve in response to pressure on a diaphragm.

6. The method defined in claim 1, wherein said step of disposing a flow control valve includes moving said valve in response to pressure in a fluid filled capsule.

7. The method defined in claim 1, wherein said step of forming said second orifice includes forming said orifice in said shut off valve.

8. The method defined in claim 1, wherein said step of disposing an electrically operated valve includes disposing a pilot operated valve.

9. The method defined in claim 1, wherein one of said steps of forming a first and second restricting orifice includes forming an orifice having a diameter of about 0.07 inches (1.78 mm) and a length of about 0.13 inches (3.3 mm).

10. An expansion valve assembly for a refrigeration system employing the method of claim 1, comprising:

(f) a valve body having an inlet adapted for receiving refrigerant of a relatively high pressure, a cross passage downstream from (g) the inlet, and an outlet for discharge at a pressure reduced significantly from the inlet pressure, and a flow passage connecting said inlet, cross passage and outlet;

(h) an electrically operated shut-off valve disposed in said flow passage and having a valve seat and a valve member moveable with respect to the valve seat and operable upon de-energization and energization for blocking and unblocking flow from said inlet to said outlet (i) a first flow restricting orifice disposed in said flow path intermediate inlet and said cross passage for throttling flow between the inlet and the cross passage;

(j) a thermally responsive flow control valve disposed in said flow path intermediate said shut-off valve and said outlet; and, (k) a second flow restricting orifice disposed in the flow path intermediate said first flow restricting orifice and said shut off valve.

11. The valve assembly defined in claim 10, wherein said first and second flow restricting orifice are about the same size.

12. The valve assembly defined in claim 10, wherein said shut-off valve is pilot operated.

13. The valve assembly defined in claim 10, wherein said second flow restricting orifice is disposed in said shut-off valve.

14. The valve assembly defined in claim 10, wherein said thermally responsive valve includes a fluid filled capsule and a diaphragm moveable in response to changes in the pressure of the fluid in said capsule.

15. The valve assembly defined in claim 10, wherein said second flow restricting orifice is associated with said shut-off valve.

16. The valve assembly defined in claim 10, wherein one of said first and second flow restricting orifices has a diameter of about 0.070 inches (1.78 mm) and a length of about 0.13 inches (3.3 mm).

17. An expansion valve assembly for a refrigeration system, comprising:

(a) a valve body having a high pressure inlet adapted for receiving refrigerant at a relatively high pressure, a cross passage, and a reduced pressure outlet for discharging refrigerant at a pressure reduced significantly from the inlet pressure, and a flow passage connecting said inlet, cross passage and outlet;

(b) an electrically operated shut-off valve disposed in said flow passage downstream from the inlet and the cross passage, and operable upon de-energization and energization for blocking and unblocking flow from said inlet to said outlet;

(c) a first flow restricting orifice disposed in said flow path intermediate said inlet and said cross passage, said first flow restricting orifice having a dimension throttling flow between the inlet and the cross passage;

(d) a thermally responsive flow control valve disposed in said flow path intermediate said shut-off valve and said outlet; and (e) a second flow restricting orifice disposed in the flow path intermediate said first flow restricting orifice and said flow control valve;

(f) wherein refrigerant flow is restricted through the first and second flow restricting orifices to reduce noise during operation of the expansion valve assembly.

18. The expansion valve assembly as in claim 17, wherein said first restricting orifice has a smaller flow area than said inlet and said cross passage.

19. The expansion valve assembly as in claim 18, wherein the cross passage is fluidly connected at its downstream end with an annular flow passage defined between a main valve seat member and an armature guide.

* * * * *